US007989715B2

(12) United States Patent
Saito

(10) Patent No.: US 7,989,715 B2
(45) Date of Patent: Aug. 2, 2011

(54) VEHICULAR OPERATION SWITCH AND METHOD FOR CONTROLLING THE SAME

(75) Inventor: Tatsuo Saito, Obu (JP)

(73) Assignee: DENSO CORPORATION, Kariya (JP)

( * ) Notice: Subject to any disclaimer, the term of this patent is extended or adjusted under 35 U.S.C. 154(b) by 641 days.

(21) Appl. No.: 11/822,747

(22) Filed: Jul. 10, 2007

(65) Prior Publication Data

US 2008/0011595 A1 Jan. 17, 2008

(30) Foreign Application Priority Data

Jul. 12, 2006 (JP) ..... 2006-192044

(51) Int. Cl.
*H01H 9/02* (2006.01)

(52) U.S. Cl. ..... 200/5 R; 200/313; 307/9.1

(58) Field of Classification Search ..... 200/5 R, 200/5 A, 17 R, 18, 341–345, 336, 296, 61.54, 200/61.55, 61.56; 341/22; 345/168, 169, 345/184; 307/9.1, 10.1

See application file for complete search history.

(56) References Cited

U.S. PATENT DOCUMENTS

| | | | | |
|---|---|---|---|---|
| 4,851,623 | A * | 7/1989 | Honda et al. | 200/314 |
| 4,868,354 | A * | 9/1989 | Ray et al. | 200/17 R |
| 6,355,893 | B1 * | 3/2002 | Ikunami | 200/339 |
| 6,455,795 | B1 * | 9/2002 | Murakami et al. | 200/345 |
| 6,909,376 | B2 * | 6/2005 | Rennick | 340/693.6 |
| 7,067,744 | B2 * | 6/2006 | Mere et al. | 200/4 |
| 7,322,819 | B2 * | 1/2008 | Lyons et al. | 431/125 |
| 2004/0140190 | A1 * | 7/2004 | Searle et al. | 200/341 |
| 2005/0121431 | A1 * | 6/2005 | Yuen | 219/387 |
| 2005/0199735 | A1 * | 9/2005 | Eisenhour et al. | 236/1 C |
| 2005/0284743 | A1 * | 12/2005 | Takiguchi et al. | 200/341 |
| 2006/0273236 | A1 * | 12/2006 | Gutbrod et al. | 250/205 |
| 2008/0002407 | A1 * | 1/2008 | Chen | 362/276 |

FOREIGN PATENT DOCUMENTS

| | | |
|---|---|---|
| JP | U-5-84910 | 11/1993 |
| JP | U-5-94922 | 12/1993 |
| JP | A-2001-222924 | 8/2001 |
| JP | A-2006-193979 | 7/2006 |

* cited by examiner

*Primary Examiner* — Michael A Friedhofer
(74) *Attorney, Agent, or Firm* — Posz Law Group, PLC

(57) ABSTRACT

An operation switch for a vehicle includes a light source and a grease. The light source is provided to illuminate a switch knob from a rear face side of the switch knob. The grease is applied to a sliding part. The light source is forcibly activated based on temperature information in a passenger compartment of the vehicle.

12 Claims, 4 Drawing Sheets

VEHICULAR OPERATION SWITCH AND METHOD FOR CONTROLLING THE SAME

CROSS REFERENCE TO RELATED APPLICATION

This application is based on and incorporates herein by reference Japanese Patent Application No. 2006-192044 filed on Jul. 12, 2006.

BACKGROUND OF THE INVENTION

1. Field of the Invention

The present invention relates to a vehicular operation switch, which includes a light source illuminating a switch knob from a rear face side, and which includes a grease that is applied to a sliding part.

2. Description of Related Art

Most of devices placed in a passenger compartment, such as a navigation system, a display, an audio system, and an air conditioner, include a light source illuminating a switch knob from a rear face side of the switch knob so that the vehicular operation switch has better visibility in the night. For example, Japanese Patent Laid-Open No. 2001-222924 bulletin discloses a vehicular operation switch that includes a light source illuminating such a switch knob from the rear face side of the switch knob.

Because, the vehicular operation switch is used frequently by a vehicle user, the touch (feel) and quality of the switch knob in the press operation are regarded as important. Because of this, a clearance in a sliding part of the switch knob during the press operation is designed to be as small as possible such that a wobble of the switch knob in the press operation is limited. Also, as for the many vehicular operation switches, a grease is applied to the sliding part such that the touch and quality of the switch knob during the press operation are improved.

As explained above, the touch of the switch knob, which includes the grease applied to the sliding part, during the press operation is good and has high quality. In contrast, a viscosity of the grease is prone to rise in accordance with a decrease of temperature, in general. Because of this, the viscosity of the grease applied to the sliding part rises when the vehicle is left unattended for a long time under an extremely low temperature environment of a cold district. Thus, the force that is necessary for the press (push) of the switch knob increases in the operation switch. In a worst case, the grease may freeze so that the switch knob becomes unable to be pressed.

Firstly, the vehicle user starts the engine of the vehicle, which has been left under the extremely low temperature environment for a long time. Then, when the air conditioning heater raises the vehicle indoor temperature to about a normal temperature, the viscosity of the grease recovers to that corresponding to the normal temperature. Therefore, the operational feel of the vehicular operation switch becomes normal. However, because the passenger compartment is very large, it generally takes a long time to raise the vehicle indoor temperature. Also, in a case, where the vehicular operation switch for turning on the air conditioning heater is frozen while the air conditioning heater is not activated, the air conditioning heater cannot be turned on. Therefore, the vehicle user will disadvantageously feel unpleasant for a long time.

SUMMARY OF THE INVENTION

The present invention is made in view of the above disadvantages. Thus, it is an objective of the present invention to address at least one of the above disadvantages.

To achieve the objective of the present invention, there is provided an operation switch for a vehicle, which includes a light source and a grease. The light source is provided to illuminate a switch knob from a rear face side of the switch knob. The grease is applied to a sliding part. The light source is forcibly activated based on temperature information in a passenger compartment of the vehicle.

To achieve the objective of the present invention, there is also provided a method for controlling an operation switch for a vehicle, which includes a light source that illuminates a switch knob from a rear face side of the switch knob and includes a grease that is applied to a sliding part. In this the method, a temperature in a passenger compartment of the vehicle is detected. Also, the light source is forcibly activated when the temperature detected by the detecting of the temperature is equal to or less than a first predetermined temperature.

To achieve the objective of the present invention, there is also provided an operation switch for a vehicle, which includes a switch knob, a light source, and a grease. The switch knob has a sliding part. The light source is provided to illuminate the switch knob from a rear face side of the switch knob. The grease is applied to the sliding part of the switch knob. The light source is forcibly activated based on temperature information in a passenger compartment of the vehicle.

BRIEF DESCRIPTION OF DRAWINGS

The invention, together with additional objectives, features and advantages thereof, will be best understood from the following description, the appended claims and the accompanying drawings in which:

DETAILED DESCRIPTION OF PREFERRED EMBODIMENTS

Hereinafter, an embodiment for carrying out the invention is explained referring to drawings.

The general feature of a vehicular operation switch used by a vehicle (operation switch for a vehicle) is explained, firstly.

Figure 1:
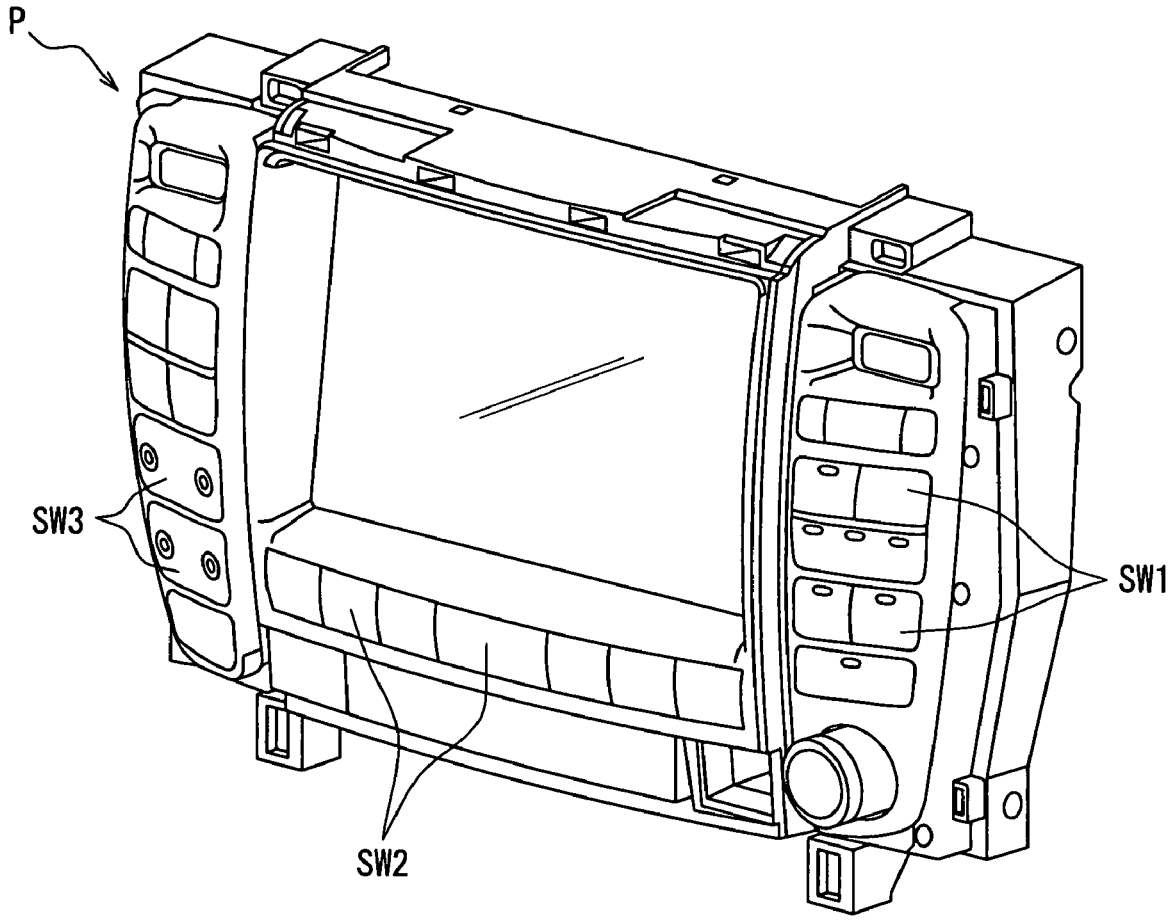
FIG. 1 is a perspective view of a panel in a passenger compartment, where operation systems, such as a navigation system, a display, an audio system, and an air conditioning apparatus, are provided together.

FIG. 1 is a perspective view of a panel in a passenger compartment, where operation systems, such as a navigation system, a display, an audio system, and an air conditioning apparatus, are provided together. Multiple different vehicular operation switches SW1-SW3 are mounted on a panel P of FIG. 1 for the operation of the navigation system, the display, the audio system, and, the air conditioning apparatus.

FIGS. 2A-2C, 3A, 3B are schematic sectional views of the vehicular operation switches SW1*a*-SW1*c*, SW2, and SW3 showing internal structure examples of the vehicular operation switches shown in FIG. 1.

Each of the vehicular operation switches SW1*a*-SW1*c*, SW2, SW3, shown in FIGS. 2A-2C, 3A, 3B has a tactile switch TSW, which is mounted on a circuit board 1. Each vehicular operation switch SW1*a*-SW1*c*, SW2, SW3, is turned on and off by pressing the switch knob N1*a*-N1*c*, N2, N3 in a direction as indicated by an outlined arrow in the drawing to push down the tactile switch TSW. Note that the switch mounted on the circuit board 1 is not limited to the tactile switch TSW. For example, the switch may be a switch of another type as long as it has an element, which responses to an operation of the switch. Also, in another case, the tactile switch TSW and a microcomputer to control a light source L, which is described later, may be mounted on the circuit board 1.

Each of the vehicular operation switches SW1*a*-SW1*c*, SW2, SW3 of FIGS. 2A-2C, 3A, 3B includes the light source L. Each light source L is used with a reflector, and lights up (illuminates) the switch knob N1*a*-N1*c*, N2, N3 from a rear face side thereof. There is a design part, such as a character, showing each switch function on each surface of the switch knobs N1*a*-N1*c*, N2, N3. Typically, the character is machined (finished) so that light transmits through the design part on the surface of the knob. Because of this, the activation of the light source L improves visibility of the design in the night (e.g., in a dark place). This is a nightlight function of the present embodiment. The activation of the light source L is controlled by, for example, the microcomputer mounted on the circuit board 1. And when a microcomputer gives an illumination ON command, an electric current is applied to the light source L on the circuit board 1 to activate the light source L. The light of the light source L travels from an inner side of the switch knob N1*a*-N1*c*, N2, N3 through the design part, such as the character, which is machined (finished) so that light penetrates therethrough. Then, the light is emitted to the passenger compartment. The light source L of the vehicular operation switch SW1*a*-SW1*c*, SW2, SW3 may be, for example, a lump bulb (miniature lamp bulb). However, the light source L is preferable to be a light emitting diode (LED). Even for the repetition of the forced activation/deactivation of the light source L of the vehicular operation switch of the present embodiment described below, a long duration of life of the light source L is reliably ensured in a case, where the light source L is LED.

Figure 2A:
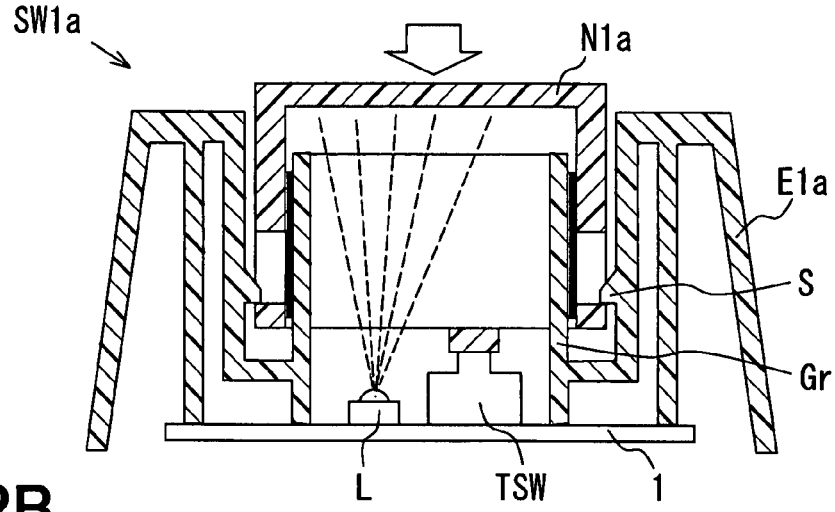
FIG. 2A is a schematic sectional view of a vehicular operation switch SW1*a* showing an internal structure example of the vehicular operation switch shown in FIG. 1.
Figure 2B:
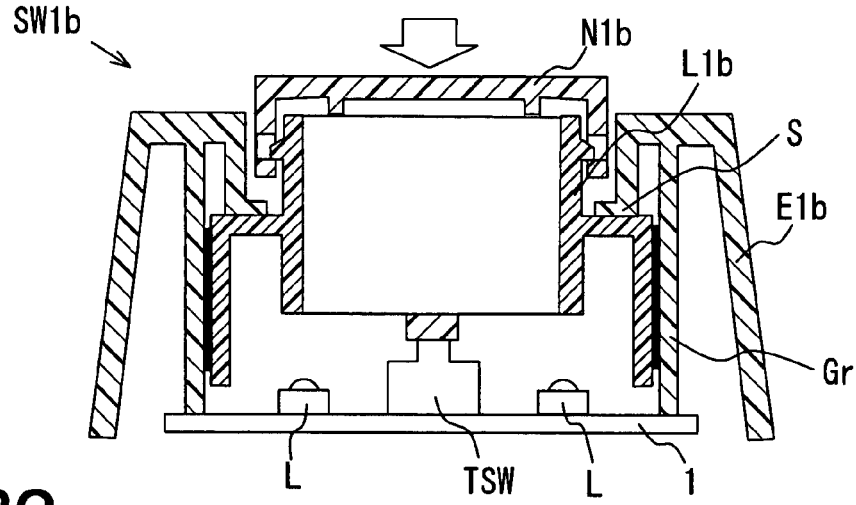
FIG. 2B is a schematic sectional view of a vehicular operation switch SW1*b* showing an internal structure example of the vehicular operation switch shown in FIG. 1.
Figure 2C:
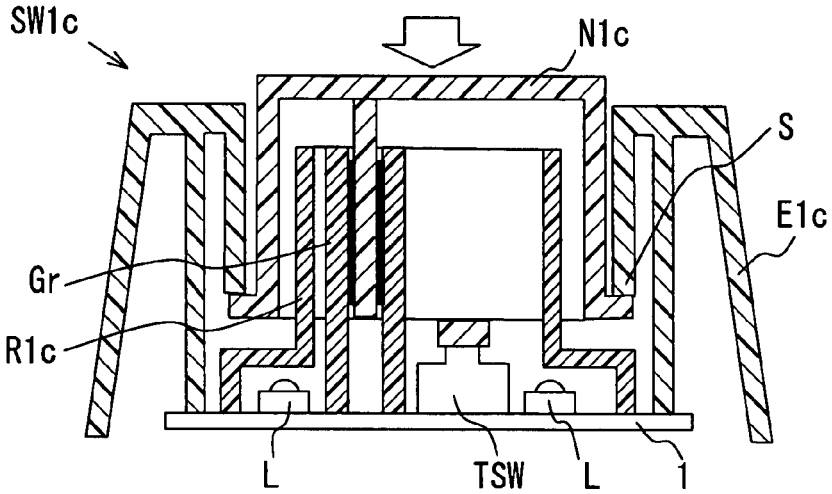
FIG. 2C is a schematic sectional view of a vehicular operation switch SW1*c* showing an internal structure example of the vehicular operation switch shown in FIG. 1.

Each vehicular operation switch SW1*a*-SW1*c* shown in FIGS. 2A-2C is a stroke type switch, in which a switch knob N1*a*-N1*c* moves in top and bottom directions in drawings.

In the vehicular operation switch SW1*a* of FIG. 2A, a guide rail Gr is formed as part of an escutcheon E1*a* that is generally made of a resin material, such as PC, ABS, PS. The switch knob N1*a*, which is made generally of a resin material, such as PC, PMMA, is provided to have a little clearance between the guide rail Gr of the escutcheon E1*a* and the switch knob N1*a*. And, an inner face of the switch knob N1*a* has a structure such that the switch knob N1*a* slides on the guide rail Gr. Similarly, in the vehicular operation switch SW1*b* of FIG. 2B, a guide rail Gr is formed as part of an escutcheon E1*b*. An outside surface of a knob rib L1*b*, which is coupled with the switch knob N1*b*, slides with the guide rail Gr. Also, in the vehicular operation switch SW1*c* of FIG. 2C, a guide rail Gr is formed as part of a reflector R1*c*, which is formed separately from an escutcheon E1*c*. And a part of the switch knob N1*c* slides with the guide rail Gr. Note that, in the vehicular operation switch SW1*c* of FIG. 2C, a vehicular operation switch may be alternatively formed such that the escutcheon E1*c* is integral with the reflector R1*c*.

In each vehicular operation switch SW1*a*-SW1*c* of the FIGS. 2A-2C, a reaction force is always applied to the switch knob N1*a*-N1*c* from the tactile switch TSW. The switch knob N1*a*-N1*c* is positioned at a predetermined elevation determined by a stopper S when the switch knob N1*a*-N1*c* is not pressed. In this way, the switch knob N1*a*-N1*c* projects from the top surface (the upward surface in the drawings) of the escutcheon E1*a*-E1*c* by a predetermined amount. The ON and OFF operation of the operation switch SW1*a*-SW1*c* is performed by pushing the projecting switch knob N1*a*-N1*c* in a direction indicated by an outlined arrow such that the tactile switch TSW is pressed. Specifically, when a surface of the switch knob N1*a*-N1*c* exposing in the passenger compartment is pushed downward (pressed), the switch knob N1*a*-N1*c* slides to displace downwardly (in a direction toward the circuit board 1) Therefore, the tactile switch TSW on the circuit board 1 is pushed, and this is converted into an electric signal for a microcomputer control.

Figure 3A:
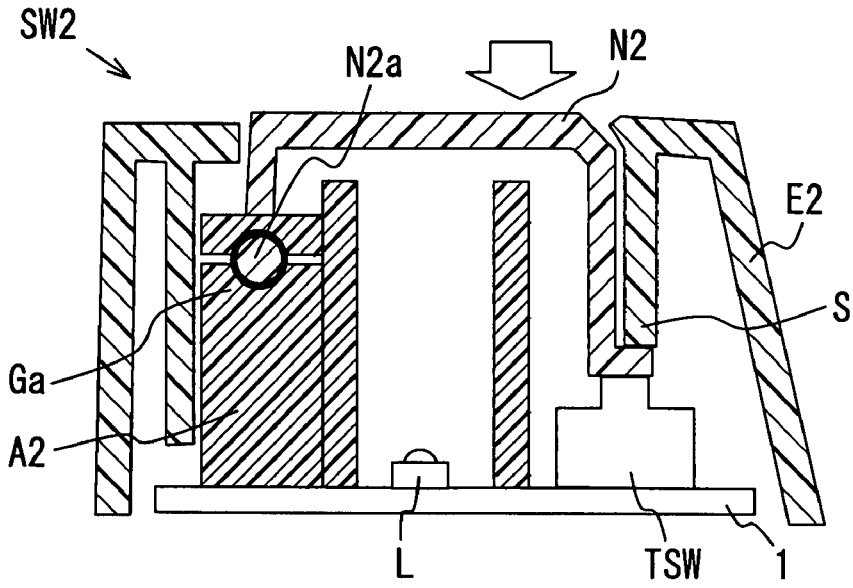
FIG. 3A is a schematic sectional view of a vehicular operation switch SW2 showing an internal structure example of the vehicular operation switch shown in FIG. 1.
Figure 3B:
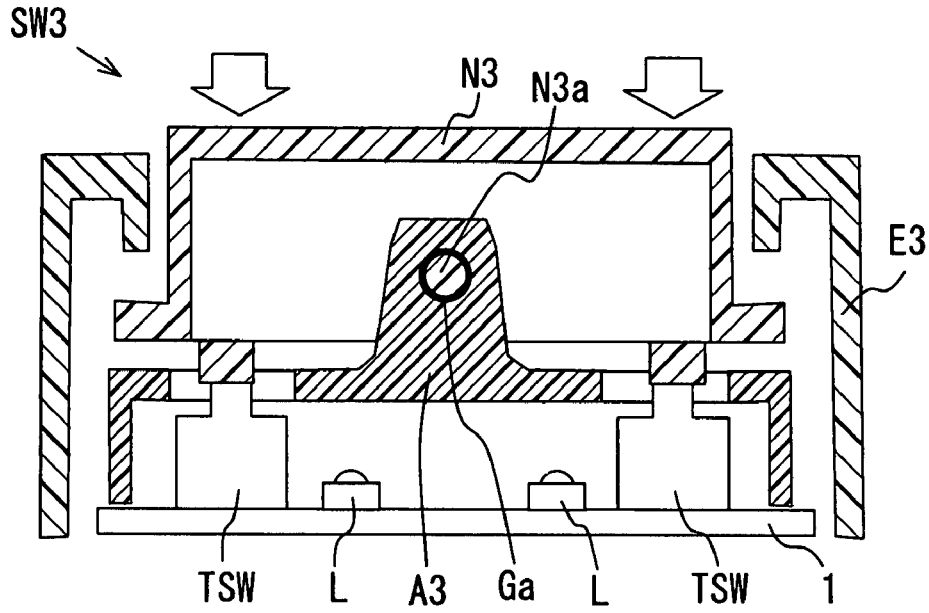
FIG. 3B is a schematic sectional view of a vehicular operation switch SW3 showing an internal structure example of the vehicular operation switch shown in FIG. 1.

The vehicular operation switch SW2 shown in FIG. 3A is a hinge type switch, in which only one side (the right side in FIG. 3A) of the switch knob N2 moves about a rotating shaft N2*a* in top and bottom directions. In the vehicular operation switch SW2 of FIG. 3A, a bearing A2 is provided separately from an escutcheon E2, and the rotating shaft N2*a* of a switch knob N2 slides with a guide bore Ga of the bearing A2. The vehicular operation switch SW3 shown in FIG. 3B is a seesaw type switch, in which both sides (left and right sides in FIG. 3B) of the switch knob N3 move about a rotating shaft N3*a* in top and bottom directions. In the vehicular operation switch SW3 of FIG. 3B, a bearing A3 is provided separately from an escutcheon E3, and the rotating shaft N3*a* of the switch knob N3 slides with a guide bore Ga of the bearing A3.

In the vehicular operation switch SW2 of FIG. 3A, the switch knob N2 is pivotable (rotatable) about the rotating shaft N2*a*. The switch knob N2 always receives a reaction force (a force in an upward direction in FIG. 3A) from the tactile switch TSW, and therefore the switch knob N2 is positioned in a predetermined elevation determined by a stopper S when the switch knob N2 is not pressed. In the vehicular operation switch SW2, the switch knob N2 projecting from the top surface (the upper surface of FIG. 3A) of the escutcheon E2 is pushed down in the direction indicated by the outlined arrow to be rotated such that the tactile switch TSW is pressed for perform the ON/OFF control.

In the vehicular operation switch SW3 of FIG. 3B, the switch knob N3 is pivotable about the rotating shaft N3*a*. The switch knob N3 always receives reaction forces (forces in an upward direction in FIG. 3B) from the tactile switches TSW installed in on both sides of the rotating shaft N3*a*, and therefore a switch knob N3 is positioned in a position, at which the reaction forces of both tactile switches TSW are balanced. In the vehicular operation switch SW3, each side of the switch knob N3 projecting from a top surface (the upper face of FIG. 3B) of the escutcheon E3 is pushed down in the direction indicated by the outlined arrows on left hand and right sides of FIG. 3B to be rotated. Thus, an ON/OFF control of each tactile switch TSW is performed.

Also, in each vehicular operation switch SW1*a*-SW1*c*, SW2, SW3 shown in FIGS. 2A-2C, 3A, 3B, a grease shown in a black heavy line in the drawings is applied to a clearance part of the above sliding part during the press operation of switch knob N1*a*-N1*c*, N2, N3. The grease improves touch of the switch knob in the press operation such that the touch of the high quality is achieved. In one embodiment, the sliding part corresponds to part of the switch knob (including e.g., the knob rib, the rotating shaft) that slides on the guide rail (guide bore). In another embodiment, the sliding part may correspond to a surface of the guide rail and an opposing surface of the switch knob, which slides on the surface of the guide rail.

Referring to FIGS. 1-3B, the general feature of the operation switch used in the vehicle has been described above.

The vehicular operation switch of the present embodiment is a vehicular operation switch, which includes a light source lighting up (illuminating) a switch knob from a rear face side, and which includes a grease that is applied to a sliding part. The control method for controlling the vehicular operation switch of the present embodiment is a control method for controlling the above described vehicular operation switch. The vehicular operation switch and the control method for controlling the same in the present embodiment forcibly activate the light source based on the temperature information in the passenger compartment.

In other words, for example, in the vehicular operation switch SW1*a*-SW1*c*, SW2, SW3 shown in FIGS. 2A-2C, 3A, 3B of the present embodiment of the present invention, the light source L lighting up the switch knob N1*a*-N1*c*, N2, N3 from the rear face side of the switch knob is forcibly activated based on the temperature information in the passenger compartment regardless of a configured state of the nightlight operation configured by the vehicle user. Thus, in a case, where, for example, the vehicle was left unattended for a long time under an extremely low temperature environment of the cold district, the light source L of the vehicular operation switch SW1*a*-SW1*c*, SW2, SW3 is forcibly activated (e.g., turned on) at timing, when the engine of the vehicle is started and the temperature information in the passenger compartment is obtained. Thus, even when the grease applied to the sliding part has obtained a high viscosity under the extremely-low temperature environment (or, even when the grease freezes up), the viscosity is rapidly decreased (or the grease is defrosted) by the heat generated by the light source L, which is forcibly activated. As a result, the vehicular operation switch SW1*a*-SW1*c*, SW2, SW3 can be recovered in a much shorter time to have a normal state of the operation and the touch (feel) of the switch knob N1*a*-N1*c*, N2, N3 in the press operation in the normal temperature in comparison with the case, where the viscosity of the grease naturally decreases (or the grease is defrosted) with the rising of the temperature in the passenger compartment.

The vehicular operation switch of the above present embodiment of the present invention is particularly suitable as a vehicular operation switch to operate an air conditioning apparatus of the vehicle. The above described vehicular operation switch can be recovered in an extremely short time to have the normal state to the press operation of the switch knob of the normal temperature. Therefore, when the vehicular operation switch is frozen in a case, where the air conditioning heater has been turned off, the air conditioning heater can be turned on in a very short time. Because of this, the vehicle user is limited from feeling unpleasant for a long time.

Figure 4:
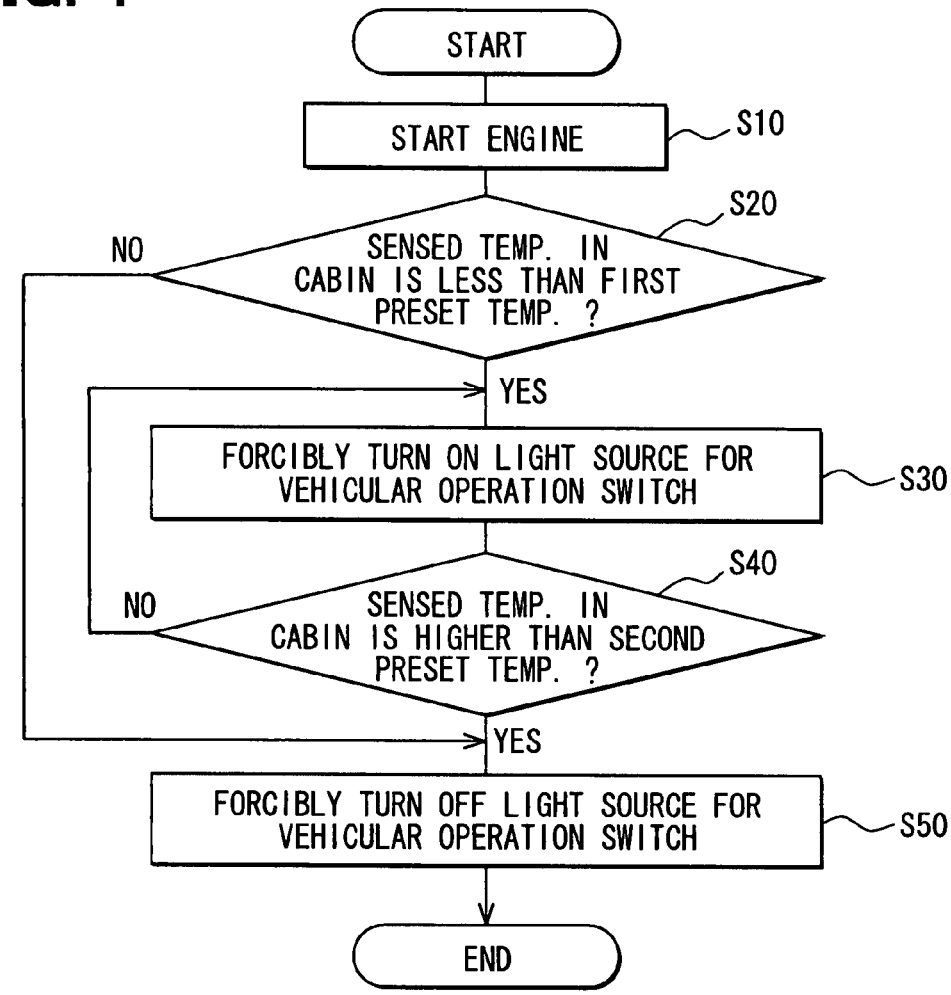
FIG. 4 is a chart showing a control flow (flow chart) to activate a light source installed in the vehicular operation switch and showing an example of a control method for controlling the vehicular operation switch of the embodiment of the present invention.

FIG. 4 is a chart showing a control flow (flow chart) to forcibly activate the light sources L installed (provided) in the vehicular operation switches SW1*a*-SW1*c*, and showing an example of a control method for controlling the vehicular operation switch of the present embodiment.

As shown in FIG. 4, in the vehicle, which is left under an extremely low temperature environment (e.g., a cold district) for a long time, firstly, at step S10, the engine is started. Thus, an electronic device controlling, for example, the air conditioning apparatus of the vehicle is turned on such that a temperature in the passenger compartment can be detected. Also, temperature in the passenger compartment (cabin) may be detected (sensed) by, for example, a thermistor of another electronic device placed in the passenger compartment of the vehicle. Thus, the temperature information in the passenger compartment is utilized in the forcible activation (and deactivation) of the light source described below through thermistors mounted on the circuit boards in various electronic devices or through communication with other apparatus, such as the electronic device (ECU) controlling the air conditioning apparatus.

Next, it is determined at step S20 whether the temperature information in the passenger compartment (e.g., the detected temperature in the passenger compartment) is equal to or less than a first predetermined temperature.

Figure 5:
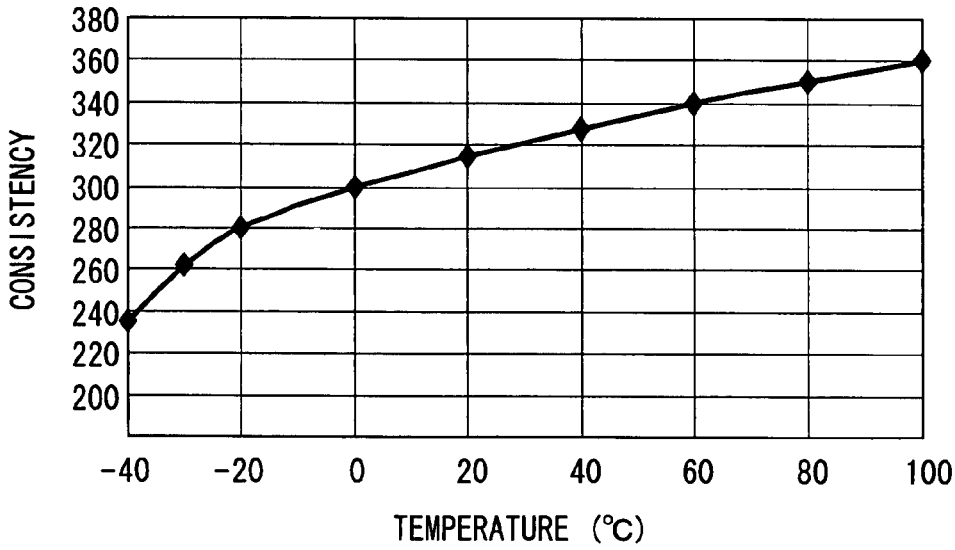
FIG. 5 is a chart showing a result of measured temperature characteristic of consistency of a grease applied to the sliding part of the vehicular operation switch.

Here, FIG. 5 shows a general temperature dependency of the viscosity of the grease used in the vehicular operation switch. FIG. 5 is a chart showing a result of a measured temperature characteristic of a consistency of the grease applied to the sliding part of the vehicular operation switch. Note that the consistency test is one of the methods to measure a hardness of the material, and the test method is standardized by JISK2220. Specifically, a normal cone is penetrated in a sample, and the hardness of the sample is indicated based on the length of the penetrated cone. Here, as the value of the consistency indicates smaller, the hardness becomes larger, opposite to the viscosity.

As shown in FIG. 5, generally, when the temperature becomes equal to or less than −20 degrees Celsius (° C.), the viscosity of the grease applied to the sliding part of the vehicular operation switch sharply rises (i.e., the consistency of the grease sharply drops). Also, when the temperature becomes equal to or less than −30 degrees Celsius, the grease may freeze up. Thus, the first predetermined temperature is set at −20 degrees Celsius, which is a boundary value to sharply raise the viscosity of the grease, or is alternatively set at −30 degrees Celsius, at which the grease comes to have higher possibility to be frozen. Here, the grease is applied to the sliding part of the vehicular operation switch. In a case, where the first predetermined temperature is set at −20 degrees Celsius, the viscosity of the grease, which has the high viscosity, starts to be decreased at next step S30. Also, in another case, where the first predetermined temperature is set at −30 degrees Celsius, the defrosting of the frozen grease can be started in next step S30.

Returning to FIG. 4 again, when it is determined that the detected temperature in the passenger compartment (cabin) is equal to or less than the first predetermined temperature at step S30, the light source L is forcibly activated (is forcibly turned on). Due to this, for example, the grease, which has been frozen, defrosts rapidly as above by the heat emitted by the light source L. Or, for example, the viscosity of the grease, which has had the high viscosity, is rapidly decreased by the heat emitted by the light source L.

Next, at step S40, it is determined whether the detected temperature in the passenger compartment (cabin) is higher than a second predetermined temperature.

For example, the second predetermined temperature is set at −20 degrees Celsius, similar to the first predetermined temperature. The second predetermined temperature serves as a criterion for determining the ending of the forcible activation of the light source L. As described earlier, the grease applied to the sliding part of the vehicular operation switch has, in general, a viscosity, which changes gently in the temperature that is higher than −20 degrees Celsius. Also, when the viscosity of the grease becomes equal to or less than −20 degrees Celsius, the viscosity suddenly rises. Thus, the forcible activation of the light source L is ended in a minimum time by setting the second predetermined temperature also at −20 degrees Celsius.

When the detected temperature in the passenger compartment is determined to be higher than second predetermined temperature, the control proceeds to step S50 to finish (end) the forcible activation of the light source L.

Thus, it is desirable that the forced activation (forcible activation) of the light source L is finished based on temperature information in the passenger compartment. The forced activation of the light source L may be finished using, for example, a timer. After having ensured that the temperature in the passenger compartment has risen to a certain predetermined value, the forced activation of the light source L is finished. Due to this, the touch of the vehicular operation switch during the press operation of the switch knob can be reliably recovered to the normal operation/touch. Also, after the recovery, the forced activation of the light source L, which has become unnecessary, is preferably finished such that the configuration (set up) of the light source L returns to a configuration of the normal nightlight operation determined by the vehicle user.

As described above, the vehicular operation switch of the present embodiment of the present invention is the vehicular operation switch, which includes the grease that is applied to the sliding member, and which provides a good and high quality touch (feel) during the press operation of the switch knob. Also, even when the vehicular operation switch is left unattended under the extremely low temperature environment for a long time, the vehicular operation switch can recover to a normal operation feel (touch) within the short time. Also, the control method for controlling the above vehicular operation switch enables the recovery of the vehicular operation switch to the normal operation feel (touch) within the short time.

Note that the light source L is forcibly activated at the time, where a switch of a light of the vehicle is turned off (for example, the forcible activation of the light source L is performed in a case, where the nightlight operation is not performed). Many of vehicular operation switches provided in the passenger compartment have nightlight operation function, and a microcomputer mounted on the vehicle easily controls activation/deactivation of the vehicular operation switches. Because of this, the structure of the vehicular operation switch of the above described in the present embodiment of the present invention and structure of the control method for controlling the same are realized without an additional component, such as a special heat generation component/mechanism/circuit. Thus, the vehicular operation switch and the control method for controlling the same do not particularly require an increased cost compared with a conventional art.

Additional advantages and modifications will readily occur to those skilled in the art. The invention in its broader terms is therefore not limited to the specific details, representative apparatus, and illustrative examples shown and described.

What is claimed is:

1. An operation switch for a vehicle comprising:

a light source that is provided to illuminate a switch knob from a rear face side of the switch knob; and grease that is applied to a sliding part, wherein the light source is forcibly activated based on temperature information in a passenger compartment of the vehicle, and the forcible activation of the light source is ended based on the temperature information in the passenger compartment of the vehicle.

2. The operation switch according to claim 1, wherein the light source is a light emitting diode.

3. The operation switch according to claim 1, wherein the operation switch is an operation switch for operating an air conditioning apparatus of the vehicle.

4. The operation switch according to claim 1, further comprising:

a controller configured to forcibly activate the light source based on the temperature information in the passenger compartment.

5. The operation switch according to claim 1, wherein:

the light source is forcibly activated when the temperature information indicates a temperature equal to or less than a first predetermined temperature; and the first predetermined temperature is one of −20° C. and −30° C.

6. The operation switch according to claim 1, wherein:

the light source is prohibited from being forcibly activated when the temperature information indicates a temperature greater than −20° C.

7. A method for controlling an operation switch for a vehicle, which includes a light source that illuminates a switch knob from a rear face side of the switch knob and includes grease that is applied to a sliding part, the method comprising:

detecting a temperature in a passenger compartment of the vehicle; and forcibly activating the light source when the temperature detected by the detecting of the temperature is equal to or less than a first predetermined temperature;

detecting the temperature in the passenger compartment of the vehicle; and ending the forcibly activating of the light source when the temperature detected by the detecting of the temperature is greater than a second predetermined temperature.

8. The method according to claim 7, wherein the first predetermined temperature is −20° C.

9. The method according to claim 7, wherein the first predetermined temperature is −30° C.

10. The method according to claim 7, wherein the second predetermined temperature is −20° C.

11. The method according to claim 7, wherein the detecting of the temperature includes detecting the temperature by an electronic device, which controls an air conditioning apparatus of the vehicle.

12. The method according to claim 7, wherein the detecting of the temperature includes detecting the temperature by a thermistor of an electronic device provided in the passenger compartment of the vehicle.

* * * * *